United States Patent [19]

Theurer

[11] 4,404,913

[45] Sep. 20, 1983

[54] TAMPING TOOL ASSEMBLY

[75] Inventor: Josef Theurer, Vienna, Austria

[73] Assignee: Franz Plasser Bahnbauma-Schinen-Industriegesellschaft mbH, Vienna, Austria

[21] Appl. No.: 309,244

[22] Filed: Oct. 7, 1981

[30] Foreign Application Priority Data

Jan. 22, 1981 [AT] Austria ..... 260/81

[51] Int. Cl.[3] ..... E01B 27/16

[52] U.S. Cl. ..... 104/12

[58] Field of Search ..... 104/7 R, 7 B, 10, 12

[56] References Cited

U.S. PATENT DOCUMENTS

| | | | |
|---|---|---|---|
| 3,153,390 | 10/1964 | Plasser et al. | 104/7 R |
| 3,799,059 | 3/1974 | Sieke et al. | 104/12 |
| 4,090,451 | 5/1978 | Theurer | 104/12 |
| 4,094,251 | 6/1978 | Theurer | 104/12 |

FOREIGN PATENT DOCUMENTS

| | | | |
|---|---|---|---|
| 2319050 | 10/1974 | Fed. Rep. of Germany | 104/12 |

*Primary Examiner*—Randolph Reese
*Attorney, Agent, or Firm*—Kurt Kelman

[57] ABSTRACT

A tamping tool assembly includes a tamping tool carrier associated with each track rail and mounted for vertical movement on a mobile track tamping machine frame. Two vibratory tamping tool supports are mounted on the carrier for pivoting about an axis extending perpendicularly to the vertical plane defined by the rail and the supports extend to the left and to the right of this plane. The upper ends of the supports are linked to a common drive for vibrating the supports. Two pairs of tamping tools are mounted on the lower ends of each support and the tamping tool pairs on one support are spaced from the tamping tool pairs on the other support so that each pair of the tamping tools is in vertical alignment with a respective one of two successive cribs between three successive track ties. The tamping tools of each pair are immersible in the respective crib upon vertical downward movement of the carrier. A drive on each support reciprocates the tamping tools of each pair towards and away from the elongated ties edges defining the respective cribs.

8 Claims, 4 Drawing Figures

TAMPING TOOL ASSEMBLY

The present invention relates to a tamping tool assembly arranged on a mobile track tamping machine for simultaneously tamping ballast underneath three successive track ties resting on the ballast. The machine includes a frame and the tamping tool assembly includes a tamping tool carrier associated with each track rail in vertical alignment therewith and mounted for vertical movement on the machine frame.

U.S. Pat. No. 3,799,059, dated Mar. 26, 1974, discloses the theoretical concept of such a machine with a tamping tool assembly wherein two pairs of tamping tools are so spaced from each other in the direction of the track that each pair of the tamping tools is in vertical alignment with a respective one of two successive cribs between three successive track ties and the tamping tools of each pair are immersible in the respective crib. One of the pairs of tamping tools is equipped with a reciprocating drive and a linkage is provided between the tamping tools of the one pair and the tamping tools of the other pair so that the tamping tools of each pair are spread apart in the respective crib to tamp ballast underneath the three adjacent track ties. The arrangement of the pivot points connecting the linkage to the tamping tools requires all four tamping tools to be of a different structure and the linkage must be changed each time the crib width changes. Furthermore, since all four tamping tools operate in synchronism, the so-called asynchronous tamping, in which the reciprocation of each tamping tool is terminated when the desired ballast density has been obtained, cannot be carried out with this assembly.

In my U.S. Pat. No. 4,094,251, dated June 13, 1978, I have disclosed an operative embodiment of a machine incorporating the principles of pairs of spreading tamping tools used for the simultaneous tamping of three successive ties. In one version of the tamping tool assembly disclosed in this patent, a vertically movable tamping tool carrier supports pairs of tamping tools whose upper ends are linked to a central vibrating drive. The reciprocating drive for each pair of tamping tools comprises a threaded spindle rotatably journaled in the carrier and a pair of nuts respectively affixed to a respective tamping tool intermediate the ends thereof. The reciprocating drive serves for synchronous tamping and while it enables all tamping tools to be of the same structure, the spindle-and-nut drive is complex and subject to frequent breakdowns. In another version, the disclosed tamping tool assembly uses hydraulic reciprocating drives connected individually to each tamping tool and this construction requires two different types of tamping tools.

It is the primary object of this invention to provide a tamping tool assembly incorporating the above-described general principles by whose structure is particularly simple, robust and very compact in the direction of the track, thus providing a relatively short assembly.

The above and other objects are accomplished according to the invention with a tamping tool assembly of the first-indicated type which includes two vibratory tamping tool supports mounted on the carrier for pivoting about an axis extending perpendicularly to a vertical plane defined by the associated track rail and extending in the direction of the track. Each support has an upper end and a lower ends, and each support extends perpendicularly to, and on both sides of, the vertical plane to the left and to the right of the associated track rail. The upper support ends are linked to a common drive for vibrating the tamping tool supports. Two pairs of tamping tools are mounted on the lower ends of each support and are arranged mirror-symmetrically with respect to the vertical plane. The pairs of tamping tools mounted on one support are spaced from the pairs of the tamping tools mounted on the other support in the direction of the track and the spacing is such that the pairs of the tamping tools mounted on each support are in vertical alignment with a respective one of two successive cribs between three successive ties, the track having two rails fastened to ties having elongated edges extending transversely to the track and adjacent elongated tie edges defining the cribs therebetween. The tamping tools of each pair are immersible in the respective cribs upon vertical movement of the carrier. Drive means mounted on each support reciprocates the tamping tools of each pair towards and away from the elongated tie edges defining the respective cribs, thus spreading the tamping tools of each pair for tamping ballast underneath the adjacent ties.

In contrast to the tamping tool assemblies of this type wherein the pairs of tamping tools immersible in the same crib to the right and to the left of the associated rail are mounted on separate supports, the arrangement of the present invention is comprised of fewer structural parts and these parts may, therefore, be dimensioned more strongly. Furthermore, there are significantly fewer bearing points so that the assembly is not only lighter and requires less material but its manufacture is easier and its maintenance less cumbersome and demanding. In addition, the tamping tool assembly of the invention requires less space in the direction of the track as well as in a direction transverse thereto. It is another advantage of this arrangement that the single vibratory support for each two pairs of tamping tools arranged mirror-symmetrically with respect to the vertical plane defined by the associated track rail assures a direct and singularly effective transmission of the vibrating force from the common vibrating drive to all of the tamping tools and, thence, to the tamped ballast. This produces a good and uniform compaction of the ballast in the critical area of intersection between rails and ties where the track is supported on the ballast bed. Since the pivoting movement of the vibratory tamping tool support is fully transmitted to the tamping tool jaws, the resistance of the ballast to their immersion therein is reduced, which facilitates and expedites the tamping operation without an increase in the required power capacity. The tamping tool assembly of this invention may readily be built into existing mobile track tamping machines without substantial structural changes therein. It provides improved access to points in the assembly requiring maintenance and improved visibility of the tamping site by the operator.

The above and other objects, advantages and features of the present invention will become more apparent from the following detailed description of a now preferred embodiment thereof, taken in conjunction with the accompanying drawing wherein FIG. 1 is a side elevational view of a tamping tool assembly according to this invention, seen in a direction transversely to the track;

Figure 1:
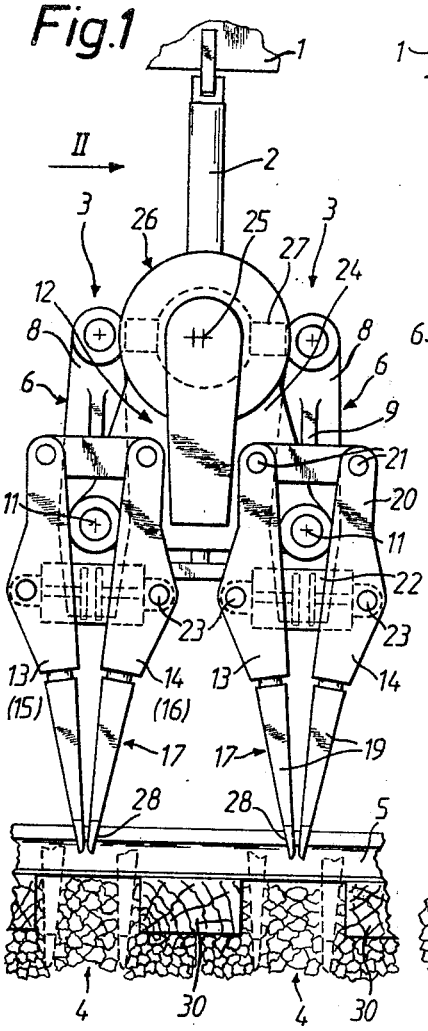
Figure 2:
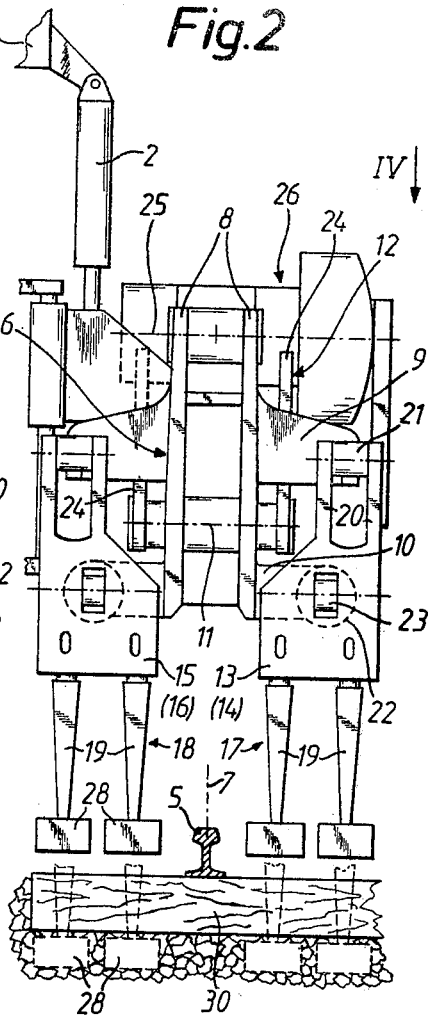
FIG. 2 is an end view of this assembly, seen in the direction of arrow II of FIG. 1.
Figure 3:
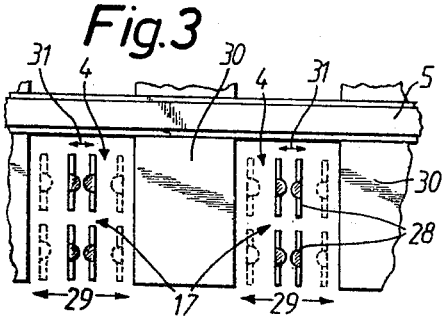
FIG. 3 is a partial top view of a track section including two successive cribs and schematically showing two pairs of tamping tools of the assembly of FIGS. 1 and 2 immersed therein.

Referring now to the drawing and first to FIGS. 1 and 2, there is shown one of two like tamping tool assemblies 3 arranged on a mobile track tamping machine for simultaneously tamping ballast underneath three successive track ties 30 resting on the ballast. The track has two rails 5 fastened to the ties which have elongated edges extending transversely of the track and adjacent ones of the elongated tie edges define cribs 4 therebetween. The machine includes frame 1 and each tamping tool assembly 1 includes tamping tool carrier 12 associated with a respective rail 5 in vertical alignment therewith and mounted for vertical movement on the machine frame by means of power drive 2 arranged to lower and raise the tamping tool carrier. Each rail 5 defines vertical plane 7 extending in the direction of the track.

According to this invention, two vibratory tamping tool supports 6 are mounted on carrier 12 for pivoting about axis 11 extending perpendicularly to vertical plane 7. Each support 6 has an upper end and a lower end, and each support extends perpendicularly to, and on both sides of the vertical plane to the left and to the right of associated track rail 5, as can be seen in FIG. 2. The upper support ends are linked to common drive 26 for vibrating the tamping tool supports.

Two pairs 17 and 18 of timing tools 13, 14 and 15, 16 are mounted on the lower ends of each support 6 and are arranged mirror-symmetrically with respect to vertical plane 7 (see FIG. 2). As shown in FIG. 1, the pairs of tamping tools mounted on one support 6 are spaced from the pairs of tamping tools on the other support 6 in the direction of the track and the spacing is such that the pairs 17, 18 of the tamping tools mounted on each support (pairs 17 being visible in FIG. 1) are in vertical alignment with a respective one of two successive cribs 4, 4 between three successive track ties 30. The tamping tools of each pair are immersible in respective crib 4 upon vertical downward movement of tamping tool carrier 12. Drive means 22 is mounted on each support 6 for reciprocating tamping tools 13, 14 and 15, 16 of each pair 18, 17 towards and away from the elongated tie edges defining respective cribs 4.

In the illustrated embodiment, drive means 22 is a hydraulic cylinder-and-piston drive arranged below pivoting axis 11 of tamping tool support 6, such hydraulic drives being commonly used in ballast tamping tool units, and the vibrating drive also is a commonly used cam shaft 25 having an axis extending parallel to, and above, the pivoting axes of the tamping tool supports and rotated by hydraulic motor 26. This arrangement provides a compact, space-saving structure since it favorably uses the space available in a vertical direction.

As shown in FIG. 1, the drive means is a relatively short drive extending between the tamping tools of each pair and the tamping tools are linked to the drive means by pivots 23 substantially centrally between the ends of the tools. This arrangement further simplifies the structure and also assures a favorable force transmission from reciprocating drives 22 to the tamping tools of each pair.

As shown in the drawing of the preferred embodiment, each support 6 comprises upwardly extending drive arm 8 and pivoting axis 11 extends through the drive arm. Carrier arm 9 is rigidly connected to the drive arm and extends transversely to vertical plane 7, tamping tools 13, 14 and 15, 16 being mounted on the carrier arm of each support. The drive arm extends in vertical plane 7. This support structure for the tamping tools is not only very simple but provides a vibratory tamping tool support of great rigidity and resistant to flexing and torsional forces, particularly when constituted by a welded structure.

In the preferred embodiment, the carrier arm extends above pivoting axis 11 and the tamping tools have upper ends pivotally mounted on the carrier arm by pivots 21. Another carrier arm 10 is rigidly connected to drive arm 8 and extends transversely to vertical plane 7 below pivoting axis 11. Drive means 22 are mounted on other carrier arm 10. The tamping tools are provided to the outer ends of carrier arms 9 and 10. This arrangement enables the direct and effective transmission of the vibrating and reciprocating forces to the tamping tools from the respective drives.

As shown in the drawing, two tamping picks 19 are detachably and replaceably affixed to each tamping tool but, if desired, the tamping tools may be equipped with a single tamping pick or with more than two picks. Each tamping tool is constituted by a pivotal lever, the upper end of each tamping tool being forked and forked upper tamping tool end 20 being supported on pivot 21 on upper carrier arm 9 for enabling the tamping tools to be pivoted about a horizontal axis extending transversely of the track. Hydraulic cylinder-and-piston drives 22 extend in the direction of the track and are affixed to lower carrier arm 10, respective ends of the piston rods of the drives being linked to the tamping tools of each pair to pivot the tamping tools about the horizontal axis. This arrangement provides a very solid pivotal support for the tamping tools and enables them flawlessly to absorb any reaction moments of varying loads to which the tamping picks are subjected.

According to another preferred feature of the present invention, tamping tool carrier 12 comprises two parallel bearing plates 24 arranged mirror-symmetrically with respect to vertical plane 7. The bearing plates support vibrating drive 25, 26 therebetween and drive arms 8 of tamping tool supports 6 extend between the bearing plates of the tamping tool carrier and are supported thereby. Drive arms 8 of both tamping tool assemblies 3 are linked to eccentric sections of cam shaft 25 of the vibrating drive by rods 27. In such a tamping tool carrier, the bearing plates may be spaced apart a relatively large distance, which provides favorable, relatively large bearing distances for the vibrating drive and the pivots of the drive arms.

FIGS. 1 and 2 show the immersed positions of the tamping tools in successive cribs 4 in broken lines, tamping jaws 28 being lowered below ties 30 and spread apart by reciprocating drives 22 to tamp ballast underneath three successive ties.

FIG. 2 schematically illustrates the positioning of the pairs 17 of the tamping tools in the shoulder portion of the ballast bed at the ends of ties 30 in two successive cribs 4. The rest or closed position of tamping jaws 28 is shown in full lines while their spread position is indicated in broken lines, the tamping tools having been spread towards the elongated edges of adjacent ties 4 in the direction of double-headed arrow 29. The superimposed vibrating motion imparted to the reciprocated tamping tools is indicated by double-headed arrow 31.

Figure 4:
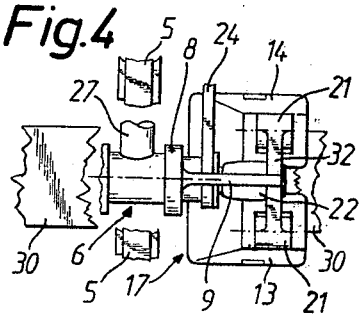
FIG. 4 is a partial top view of the tamping tool assembly of FIGS. 1 and 2 in the range of one pair of tamping tools, with the underlying track section, seen in the direction of arrow IV of FIG. 2.

FIG. 4 illustrates a pair 17 of tamping tools, portions of vibrating drive 25, 26 being omitted for the sake of clarity. As can be seen in this figure, pivots 21 of tamping tools 13, 14 are supported on transverse brace 32 of upper carrier arm 9, for instance by welding the tamping tools thereto, and are rigidly connected to drive arm 8 of pivotal carrier 6.

It is within the scope of the present invention, to use each tamping tool assembly 3 individually as well as to combine several such assemblies into one unit. Various types of tamping tools may be used and their mounting on the pivotal carrier as well as the structure and arrangement of the reciprocating drives also may be varied. For instance, the pivots for the tamping tools may be arranged substantially centrally between their ends and the upper ends of the tamping tools by be linked together by the reciprocating drive. Furthermore, spindle-and-nut drives instead of hydraulic cylinder-and-piston drives may be used for the reciprocation of the tamping tools.

What is claimed is:

1. A tamping tool assembly arranged on a mobile track tamping machine for simultaneously tamping ballast underneath three successive track ties resting on the ballast, the track having two rails fastened to ties having elongated edges extending transversely of the track and adjacent ones of the elongated tie edges defining cribs therebetween, the machine including a frame and the tamping tool assembly including (a) a tamping tool carrier associated with each one of the track rails in vertical alignment therewith and mounted for vertical movement on the machine frame, each track rail defining a vertical plane extending in the direction of the track, (b) two vibratory tamping tool supports mounted on the carrier for pivoting about an axis extending perpendicularly to the vertical plane, each support having an upper end and a lower end, and each support extending perpendicularly to, and on both sides of, the vertical plane to the left and to the right of the associated track rail, (c) a common drive for vibrating the tamping tool supports, the upper support ends being linked to the common vibrating drive, (d) two pairs of tamping tools mounted on the lower ends of each one of the supports and arranged mirror-symmetrically with respect to the vertical plane, the pairs of tamping tools mounted on one of the supports being spaced from the pairs of tamping tools mounted on the other support in the direction of the track and the spacing being such that the pairs of the tamping tools mounted on each support are in vertical alignment with a respective one of two successive ones of the cribs between the three successive track ties, the tamping tools of each pair being immersible in the respective crib upon vertical downward movement of the carrier, and (e) drive means mounted on each one of the supports for reciprocating the tamping tools of each pair towards and away from the elongated tie edges defining the respective cribs.

2. The tamping tool assembly of claim 1, wherein each one of the drive means is a hydraulic cylinder-and-piston drive arranged below the pivoting axis of the tamping tool support, and the vibrating drive has an axis extending parallel to, and above, the pivoting axes of the tamping tool supports.

3. The tamping tool assembly of claim 1 or 2, wherein each one of the drive means is a relatively short drive extending between the tamping tools of each pair, the tamping tools being linked to the drive means substantially centrally between the ends of the tools.

4. The tamping tool assembly of claim 1 or 2, wherein each one of the tamping tool supports comprises an upwardly extending drive arm, the pivoting axis extending through the drive arm, and a carrier arm rigidly connected to the drive arm and extending transversely to the vertical plane, the tamping tools being mounted on the carrier arm.

5. The tamping tool assembly of claim 4, wherein the drive arm extends in the vertical plane.

6. The tamping tool assembly of claim 4, wherein the carrier arm extends above the pivoting axis and the tamping tools have upper ends pivotally mounted on the carrier arm, and further comprising another carrier arm rigidly connected to the drive arm and extending transversely to the vertical plane below the pivoting axis, the drive arms being mounted on the other carrier arm.

7. The tamping tool assembly of claim 6, wherein each one of the tamping tools is constituted as a pivotal lever, the upper end of each tamping tool being forked and the forked upper tamping tool end being supported on a pivot on the upper carrier arm.

8. The tamping tool assembly of claim 7, wherein the tamping tool carrier comprises two parallel bearing plates arranged mirror-symmetrically with respect to the vertical plane, the bearing plates supporting the vibrating drive therebetween, and the drive arms of the tamping tool supports extending between the bearing plates of the tamping tool carrier and being supported thereby.

* * * * *